US006390428B1

(12) United States Patent
Oshima

(10) Patent No.: US 6,390,428 B1
(45) Date of Patent: May 21, 2002

(54) TUBE CORE AND HOLDERS FOR STENCIL SHEET ROLL

(75) Inventor: Kenji Oshima, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/503,180

(22) Filed: Feb. 14, 2000

(30) Foreign Application Priority Data

Feb. 18, 1999 (JP) ..... 11-040210

(51) Int. Cl.[7] ..... A47H 1/10

(52) U.S. Cl. ..... 248/266; 242/613.4; 242/613.5; 248/268

(58) Field of Search ..... 248/201, 309.2, 248/251, 254, 266, 268; 242/613.5, 613.4, 608, 608.2; 206/397; 211/57.1, 125

(56) References Cited

U.S. PATENT DOCUMENTS

| | | | | | |
|---|---|---|---|---|---|
| 1,107,328 | A | * | 8/1914 | Linder | 242/578 |
| 1,180,955 | A | * | 4/1916 | Stuck | 242/609 |
| 1,809,267 | A | * | 6/1931 | Cushing | 206/415 |
| 4,874,139 | A | * | 10/1989 | Kewin | 242/609.4 |
| 5,053,811 | A | * | 10/1991 | Watable et al. | 206/397 |
| 5,236,141 | A | * | 8/1993 | Kewin | 242/611.2 |
| 5,393,010 | A | * | 2/1995 | Renck | 242/613.5 |
| 5,469,619 | A | * | 11/1995 | Renck | 242/613.5 |
| 5,657,944 | A | * | 8/1997 | Kwein | 242/559.2 |
| 6,193,186 | B1 | * | 2/2001 | Kewin | 242/613.5 |

FOREIGN PATENT DOCUMENTS

| | | |
|---|---|---|
| DE | 43 01 625 A1 | 7/1994 |
| EP | 0 311 829 | 4/1989 |
| FR | 533223 | 2/1922 |
| GB | 606677 | 8/1948 |
| JP | 8-175707 | 7/1986 |
| JP | 61-200849 | 12/1986 |
| JP | 62-23252 | 2/1987 |
| JP | 4-83769 | 7/1992 |
| JP | 11-40210 | 2/1999 |
| NL | 6408370 | 1/1965 |

OTHER PUBLICATIONS

Japanese Utility Model Laid–open (Kokai) No. Sho. 62–23252.

Japanese Utility Model Lain–open (Kobai) No. Hei. 04–83769.

Japanese Utility Model Laid–open (Kobai) Sho. 61–200849.

Patent Abstracts of Japan, N. Masaharu, Rolled Recording Paper and Movable Flange for Rotatably Supporting Rolled Recording Paper, Publ. No.08–175707, Publ. Date: Jul. 9, 1996.

* cited by examiner

*Primary Examiner*—Ramon O. Ramirez
*Assistant Examiner*—Tan Le
(74) *Attorney, Agent, or Firm*—Fitch, Even, Tabin & Flannery

(57) ABSTRACT

There is provided a tube core for a stencil sheet roll, and holders fitted to the tube core, which are simple in construction and low in cost, and capable of preventing the roll from being erroneously mounted in an irrelevant machine without fail. The tube core for the stencil sheet roll (R) has two ends in which the holders (H, H") are installed. The holders have a guide plate (21) and a projection (22, 23) projecting therefrom. The tube core has openings (14, 16) at,the ends into which the projections (22, 23) are inserted. The openings are different in inner dimension from each other such that the projections different in dimension from each other are fitted therein respectively. The tube core is formed of a first tube (11). The end opening (14) of the tube core is formed by one of the openings of the first tube (11), while the other opening (16),of the tube core is equal to an opening (16) of a second tube (15) which is nested in the first tube at a location neighboring to the other end opening of the tube (11). The tube (15) may be internally spaced a predetermined distance away from the end of the tube (11), to form a step portion (17), and the holder (H") may have a shoulder portion (24) so as to be housed in the step portion.

4 Claims, 3 Drawing Sheets

TUBE CORE AND HOLDERS FOR STENCIL SHEET ROLL

BACKGROUND ART

1. Field of the Invention

This invention relates to a tube core and a pair of holders for a stencil sheet roll which is mounted in a stencil printing machine when used.

2. Detailed Description of the Prior Art

As shown in FIG. 5, the stencil sheet roll R is conventionally produced by winding a length of stencil sheet 12 around,a cylindrical tube core 11. The tube core 11 is generally made of used cardboard and shaped like a cylinder. This tube core 11 may also be called a cardboard spool.

To mount the stencil sheet roll R in a stencil printing machine, a pair of holders H are required which are installed in both end openings 13, 14 of the tube core 11. Each holder H is formed by a disk-shaped guide plate 21 which extends along the end surface of the roll R to guide an edge of the stencil sheet 12 drawn from the roll R, and a cylindrical projection 22 like a stub concentrically projecting from the guide plate 21. The holder H can be installed in the roll R by inserting and fitting the projection 22 into each of the end openings 13, 14 of the tube core 11 in a plug-in manner. An external diameter of the projection 22 is designed to be almost equal to an internal diameter of each of the end openings 13, 14 of the tube core 11, and therefore the projection 22 can be inserted and fitted into each end opening 13, 14 of the tube core 11 as it is.

In order to cope with various applications, it has recently been required for stencil printing machines to be varied in type with respect to the size ranging from a large machine to a small machine, or with respect to the resolution ranging from a low-resolution machine to a high-resolution machine. Accordingly, the stencil sheet is sometimes required to be different in its properties according to the type of the machine. Therefore, it is necessary to prevent a stencil sheet from being erroneously mounted in an irrelevant machine.

To eliminate the erroneous mounting, various preventive methods have been suggested. For example, it is proposed, in Japanese Utility Model Laid-Open No. 83769/1992, that notches or projections are formed in or on the end surface of the tube core, which are different in shapes according to types of the stencil sheet. Alternatively, the tube core is subjected to a specific treatment for discriminating the types of the stencil sheet. These proposed methods, however, have inconveniences such that processing of the tube core requires preciseness, or manufacturing cost of the tube core unfavorably becomes expensive.

SUMMARY OF THE INVENTION

It is therefore an object of the present invention to provide a tube core for a stencil sheet roll, and holders adapted to fit in the tube core, which are simple in construction and low in cost, and capable of preventing the roll from being erroneously mounted in an irrelevant machine without fail.

To attain the object, the present invention provides a tube core for a stencil sheet roll, having two end openings adapted to receive a holder that has a guide plate for guiding an edge of the stencil sheet and a projection projecting from the guide plate for fitting in the opening, in which said openings are different in inner dimension from each other, whereby they receive holders different in dimension of said projection.

The tube core is generally comprised of a cylindrical main body, and the openings thereof can be formed at both ends of the tube core, e.g. by arranging circular openings different in internal diameter from each other, in a manner concentric with the main body. The circular openings different in internal diameter can be molded when the tube is integratedly formed of plastic. Alternatively, the main body may be formed, e.g. by a cylindrical first tube, and one opening of the main body may be one of the end openings of the first tube, while the other opening may be defined by an end opening of a second tube which has been nested and secured in the first tube at a location neighboring to the other end opening of the first tube.

The second tube may be arranged such that an end thereof may be flush with the other end of the first tube. Alternatively, the second tube may be arranged at a location internally spaced a predetermined distance away from the end of the first tube such that a step portion is formed between the end of the first tube and the end of the second tube. In the latter case, the holder may have a shoulder portion formed thereon, which is shaped to be complementary with the step portion, whereby the shoulder portion is housed in the step portion in the tube core at the time of installation of the holder. As a result, combination of the external diameter of the projection of the holder and the dimension of the step portion makes it possible to differentiate varieties of stencil sheet rolls.

Thus, according to another aspect of the invention, there is provided a holder adapted to fit in a tube core of a stencil sheet roll, said tube core comprising a first tube and a second tube nested in the first tube to form an end opening having a step portion in the tube core, which comprises a guide plate for guiding an edge of the stencil sheet drawn from the roll, and a projection projecting from the guide plate and having a shoulder portion in a manner bordering on the guide plate and the projection so as to be housed in said step portion of the opening of the tube core. A spool for stencil sheet can be constituted by a pair of the present holders and the present tube core.

The above and other objects, features and advantages of the invention will be more apparent from the following detailed description taken in conjunction with the accompanying drawings.

DESCRIPTION OF THE PREFERRED EMBODIMENTS

Figure 1:
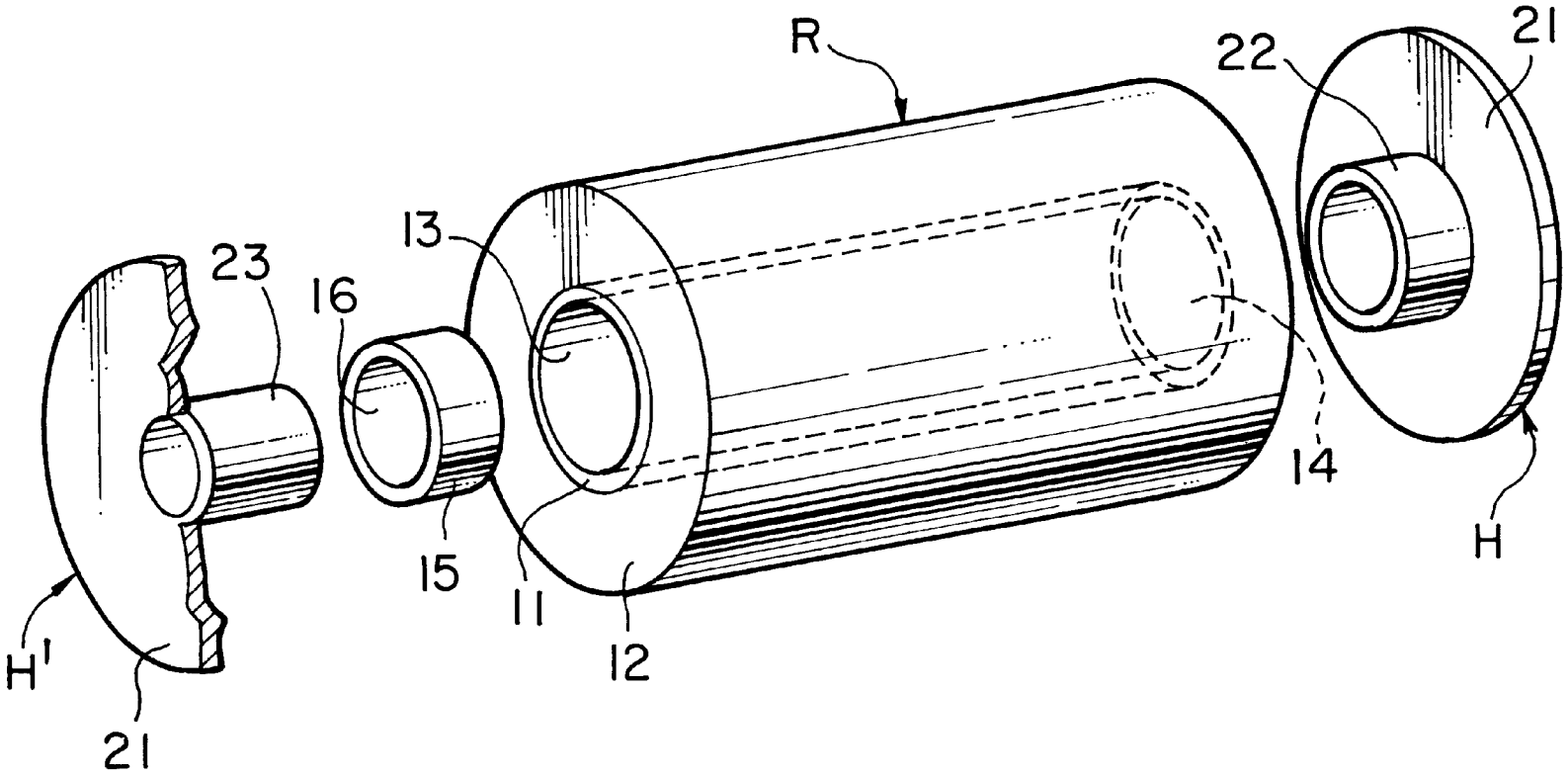
FIG. 1 is an exploded perspective view showing a roll of stencil sheet wound around a tube core and holders according to a first embodiment of the invention.

The invention will now be described in detail with reference to the drawings showing embodiments thereof, which, however, does not limit the scope of the invention. In this connection, component parts of the embodiments of the invention, which have similar functions as those in the aforementioned conventional technique are designated by identical reference numerals.

Figure 2:
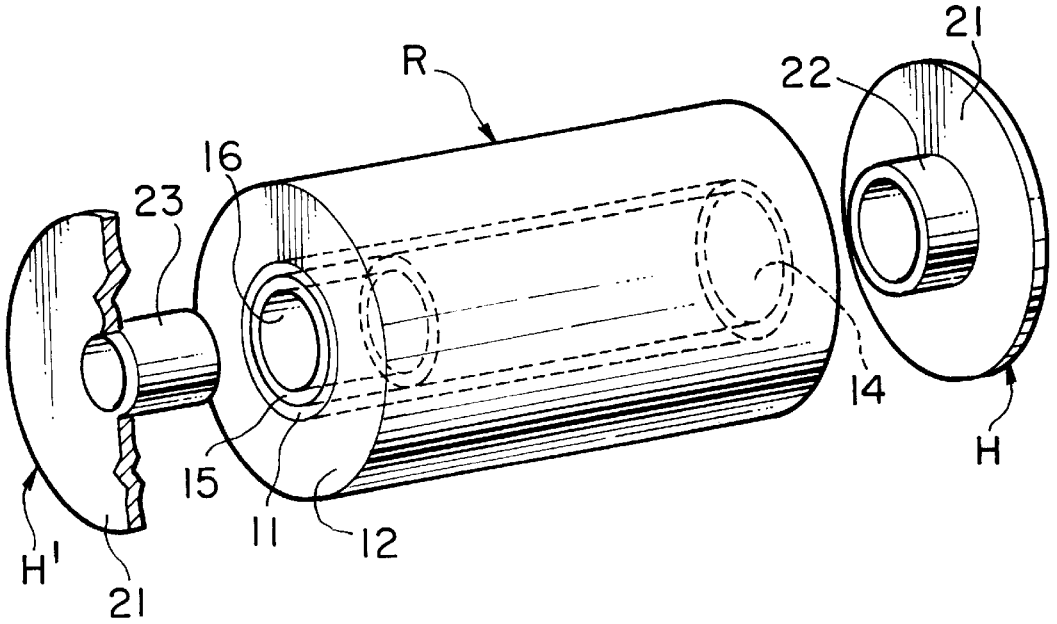
FIG. 2 is a perspective view showing a roll of stencil sheet and the holders before installation thereof in the roll, according to the first embodiment.
Figure 5:
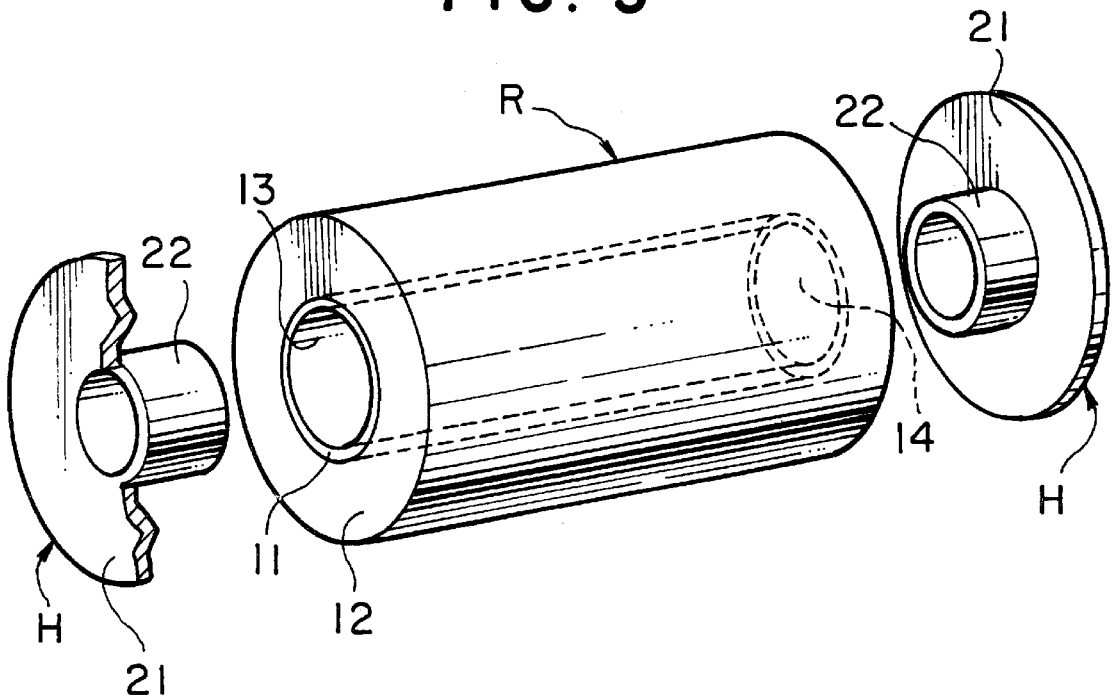
FIG. 5 is a perspective view showing a roll of stencil sheet wound around a conventional tube core, and conventional holders before installation thereof.

Referring first to FIGS. 1 and 2, there is schematically illustrated a first embodiment of the invention. In FIG. 1, a stencil sheet roll R is formed by a length of stencil sheet or stencil paper 12 wound around a first tube 11 made of paper or cardboard and shaped like a cylindrical hollow tube which opens at both ends thereof. This formation is the same as the formation of the conventional stencil sheet roll R shown in FIG. 5. The first tube 11 has a right end opening 14 in which a holder H similar to that of FIG. 5 is installed when used. The holder H has a cylindrical stub-like projection 22 which projected from a disc-like guide plate 21 and has an external diameter almost equal to an internal diameter of the tube 11. Therefore, by inserting and fitting the projection 22 into the opening 14, the holder H can be installed in the roll R in a plug-in manner. At this moment, the holder H is pressed into the opening 14 until a guide plate 21 of the holder H abuts the edge of the stencil sheet. To facilitate the insertion of the projection 22, the projection may taper off toward the front end thereof.

On the other hand, the tube 11 in FIG. 1 has a left end opening 13 in which a second tube 15 is nested and secured. The second tube 15 is a cylindrical hollow tube opening at both ends thereof. The second tube 15 is a short tube having an external diameter almost equal to the internal diameter of the first tube 11. It may be made, e.g. of the same cardboard as the first tube 11, and bonded to the internal periphery of the first tube 11 with a bonding agent such as an adhesive. The cardboard tube is advantageous in that it can simply and inexpensively be formed in the same manner as in the conventional tube core by winding cardboard around a mandrel and then cutting the thus-wound cardboard to have a desired length.

As understood from FIG. 2, the second tube 15 is arranged in the first tube 11 such that its left end is flush with the left end of the first tube 11. Accordingly, the left end opening of the tube core of the roll R is defined by an opening 16 of the second tube 15. A holder H' having a cylindrical projection 23 is installed in the opening 16 in a plug-in manner, when used. In other words, the projection 23 has an external diameter almost equal to an internal diameter of the tube 15, and therefore by inserting and fitting the projection 23 into the opening 16, the holder H' can be installed in the roll R. The wall thickness of the tube 15 may be varied according to the types of the stencil sheet as appropriate. To facilitate the insertion of the projection 23, the projection 23 may taper off toward the front end thereof.

As described hereinabove, according to the embodiment shown in FIGS. 1 and 2, the internal diameters of the right and left openings 14, 16 can be easily made varied. In other words, by making the wall thickness of the tube 15 different depending on the types of the stencil sheet, various types of the stencil sheet can be differentiated, which leads to prevention of erroneous installation of the roll R in a printing machine. It is needless to say that according to the invention, a third tube having a further different wall thickness may be securely nested in the right end opening of the first tube, whereby the right and left openings of the tube core are made different in internal diameter.

Figure 3:
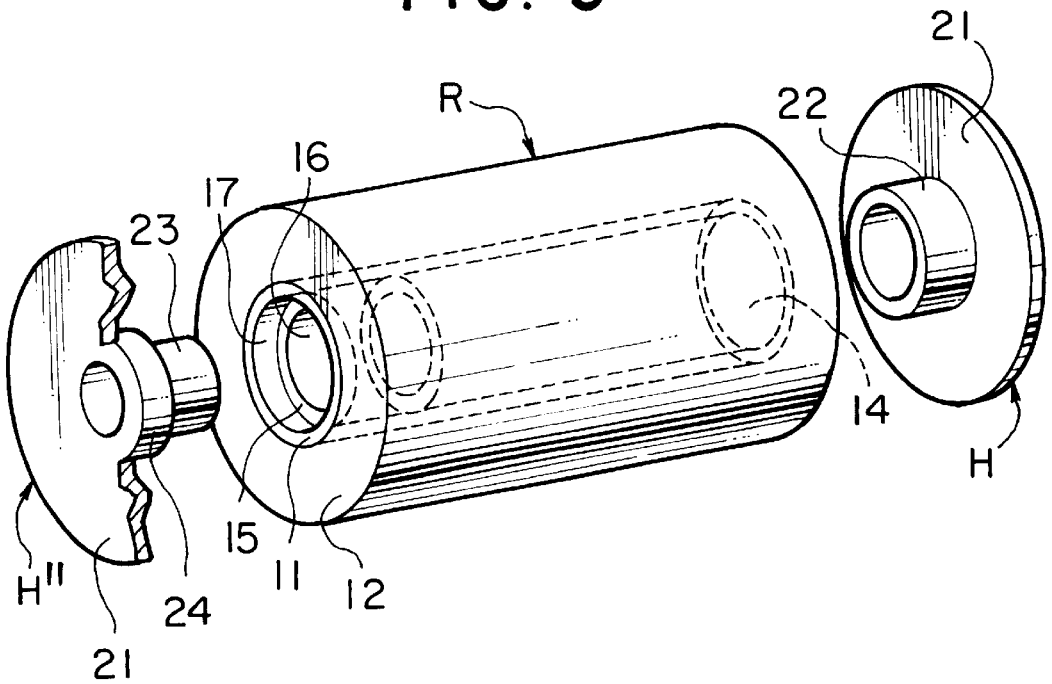
FIG. 3 is a perspective view showing a roll of stencil sheet wound around a tube core and holders before installation thereof, according to a second embodiment of the invention.
Figure 4:
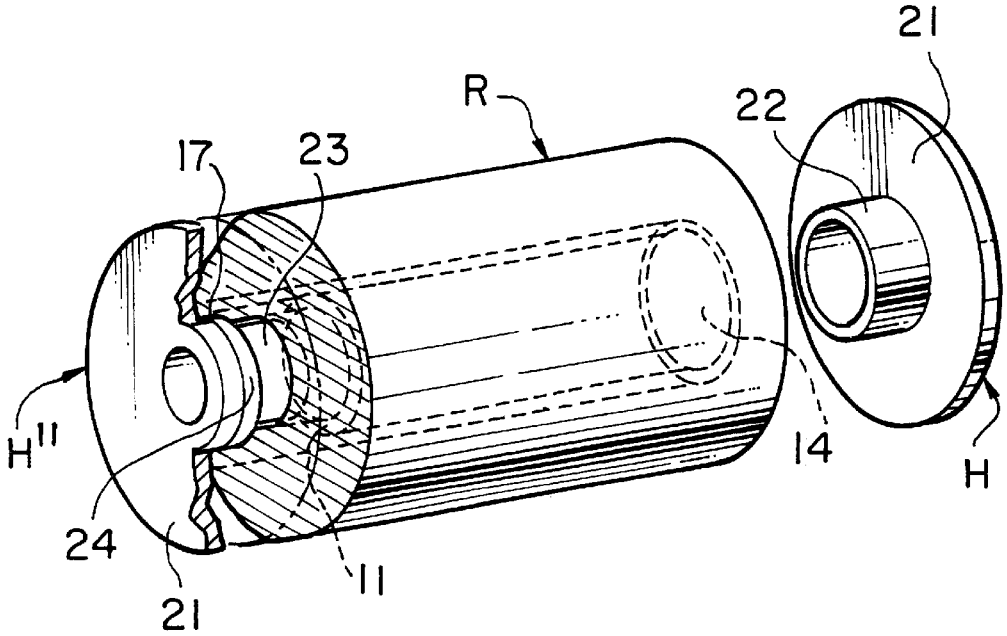
FIG. 4 is a partially cut-away perspective view showing the tube core and the installed holder according to the second embodiment.

FIGS. 3 and 4 show a second embodiment of the invention. In the present embodiment, the second tube 15 is arranged in the first tube 11 such that its left end is placed somewhat internally with respect to the left end of the first tube 11. Except for this, the tube core in this embodiment is identical with that of the first embodiment shown in FIGS. 1 and 2. More specifically, in the present embodiment, the left end of the second tube 15 is arranged so as to be spaced at a short distance internally away from the left end of the first tube 11 to form a step portion 17 at a location between the left end of the first tube 11 and the left end of the second tube 15. On the other hand, a holder H" to be inserted into the second tube 15 is formed with an annular shoulder portion 24 which has a shape complementary to the step portion 17 and borders on both the guide plate 21 and the projection 23. Therefore, as clear from FIG. 4, when the holder H" is installed in the roll R, the projection 23 is inserted into the second tube 15 while the shoulder portion 24 is housed in the step portion 17. Accordingly, even if the stencil sheet roll R shown in FIGS. 1 and 2 is intended to be mounted in a stencil printing machine which is equipped with the holder H", the shoulder portion 24 abuts against the end of the tube 15, so that the holder H" cannot be completely inserted into the opening 16. As a result, the user of the machine can easily recognize that the stencil sheet roll in question is irrelevant to the machine in question, thereby preventing erroneous mounting of the roll.

As described hereinabove, according to the second embodiment, not only the internal diameters of the right and left openings of the tube core are made different but also the dimensions of the step portion, e.g., the distance from the left end of the tube core is made different depending on the types of the stencil printing machines. As a result, the stencil sheet roll can be prevented from being erroneously mounted in an irrelevant machine in spite of the variety of types of the machines. Further, in the second embodiment, if the distance between the left end of the first tube 11 and the left end of the second tube 15 is fixed and only the wall thickness of the second tube 15 is made different to discriminate the various types of the stencil sheet rolls, operability can be particularly enhanced in the step of producing the stencil sheet roll, i.e. in the step of winding the stencil sheet around the tube core. The reason is as follows: In this step, a pair of chucks are inserted into both ends of the tube core and secured in the same. The chucks each have a stub portion having an external diameter almost equal to the internal diameter of each end opening, which are then rotated together with the tube core, to thereby wind the stencil sheet. Therefore, to efficiently carry out the process in this step, it is advisable that the stub portions of both chucks have the same dimension such that its external diameter and length correspond to the internal diameter of the step portion 17 (i.e., the internal diameter of the first tube 11) and the distance between the end of the 10 first tube 11 and the end of the second tube 15 in the step portion 17, respectively. In this case, even if various types of stencil sheet rolls are produced, in which the second tubes 15 thereof are made different in wall thickness from each other to discriminate the stencil sheet rolls, the common chucks can be used. As a result, the chucks need not be exchanged depending on the type of the stencil sheet roll, leading to enhanced operability. The shoulder portion 24 is annually shaped in the figures, but it may be formed by spaced projections.

According to the present invention, a tube core of a stencil sheet roll has end openings into which stub-like projections of holders are inserted. The openings are made different in inner dimension or size, and incompatible with each other. As a result, the stencil sheet roll can be prevented from being erroneously mounted in an irrelevant machine. Further, a step portion and a shoulder portion which are complementarily shaped to each other are formed in the tube core and on the holder projection, respectively. As a result, the formation of these portions can further cope with differentiation of diversified types of stencil sheets for prevention of erroneous mounting.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A tube core for a stencil sheet roll and a holder adapted to fit in said tube core, wherein said tube core comprises a first tube and a second tube nested in said first tube to form an end opening having a step portion in the tube core; and said holder comprises a guide plate for guiding an edge of the stencil sheet drawn from the stencil sheet roll, and a projection projecting from the guide plate and having a shoulder portion in a manner bordering on the guide plate and the projection so as to be housed in said step portion of the opening of the tube core.

2. A holder as claimed in claim 1, wherein said shoulder portion is annularly arranged along an external surface of said projection of said holder.

3. A tube core for a stencil sheet roll, said tube core comprising a cylindrical main body having openings at each end thereof, said main body comprising a cylindrical first tube and a second tube nested and secured in said first tube, said second tube being arranged in said first tube at a location internally spaced a predetermined distance away from an end of said first tube such that a step portion is formed between said end of said first tube and an end of said second tube.

4. A method for preventing erroneous installation of a stencil sheet roll in a stencil printing machine, which comprises providing a stencil printing machine with a holder and using a tube core for a stencil sheet roll which comprises a cylindrical main body having openings at each end thereof, said main body comprising a cylindrical first tube and a second tube nested and secured in said first tube, said second tube being arranged in said first tube at a location internally spaced a predetermined distance away from an end of said first tube such that a step portion is formed between said end of said first tube and an end of said second tube, wherein said holder is adapted to fit in said tube core and comprising a guide plate for guiding an edge of a stencil sheet drawn from the roll, and a projection projecting from the guide plate and having a shoulder portion in a manner bordering on the guide plate and the projection so as to be housed is said step portion of the tube core.

* * * * *